United States Patent [19]

Brehmer et al.

[11] Patent Number: 4,873,421

[45] Date of Patent: Oct. 10, 1989

[54] LIQUID-FILLED ELECTRIC RADIATOR

[75] Inventors: Roland Brehmer, Fellingsbro, Sweden; Adolfo Papi, Arras, France

[73] Assignee: AB Fellingsbro Verkstader, Sweden

[21] Appl. No.: 919,810

[22] PCT Filed: Feb. 7, 1986

[86] PCT No.: PCT/SE86/00053

§ 371 Date: Oct. 27, 1986

§ 102(e) Date: Oct. 27, 1986

[87] PCT Pub. No.: WO86/04666

PCT Pub. Date: Aug. 14, 1986

[30] Foreign Application Priority Data

Feb. 8, 1985 [SE] Sweden ..... 8500586

[51] Int. Cl.[4] ..... H05B 1/02; F24H 3/10

[52] U.S. Cl. ..... 219/341; 165/170; 219/365; 237/16

[58] Field of Search ..... 219/365, 341, 378; 237/16–18; 165/170

[56] References Cited

U.S. PATENT DOCUMENTS 1,727,564 9/1929 Salisbury ..... 219/341 X

FOREIGN PATENT DOCUMENTS 1916731 12/1970 Fed. Rep. of Germany .
922393 1/1947 France ..... 219/341
1284380 1/1962 France .
1300313 6/1962 France .
1424584 12/1964 France ..... 219/341
1586411 1/1970 France .
256582 1/1928 Italy ..... 219/341
480588 5/1953 Italy ..... 219/341
59936 10/1938 Norway .
61522 10/1939 Norway .
230458 4/1944 Switzerland ..... 219/341
1018525 1/1966 United Kingdom ..... 165/170

*Primary Examiner*—Anthony Bartis
*Attorney, Agent, or Firm*—Paul & Paul

[57] ABSTRACT

A liquid-filled electric radiator has a rectangular, vertically disposed radiator body with an upper horizontal distribution duct connected to a lower horizontal collection duct by a plurality of vertical connecting ducts within the radiator body. An angularly bent uniform cross section pipe has its free ends connected to the upper and lower ducts at diagonally opposite positions on the radiator body and includes a first section arranged parallel and level with the lower duct in series with a second section parallel to a vertical side of the radiator body. An electric immersion heater housed in the first section heats the liquid filling the ducts, vessel and pipe for circulation through the radiator body and pipe and is controlled by a thermostat positioned in a casing arranged at the lower corner of the radiator body and protected from radiation from the radiator body by a partition protruding from the casing.

3 Claims, 2 Drawing Sheets

LIQUID-FILLED ELECTRIC RADIATOR

TECHNICAL FIELD

Figure 1:
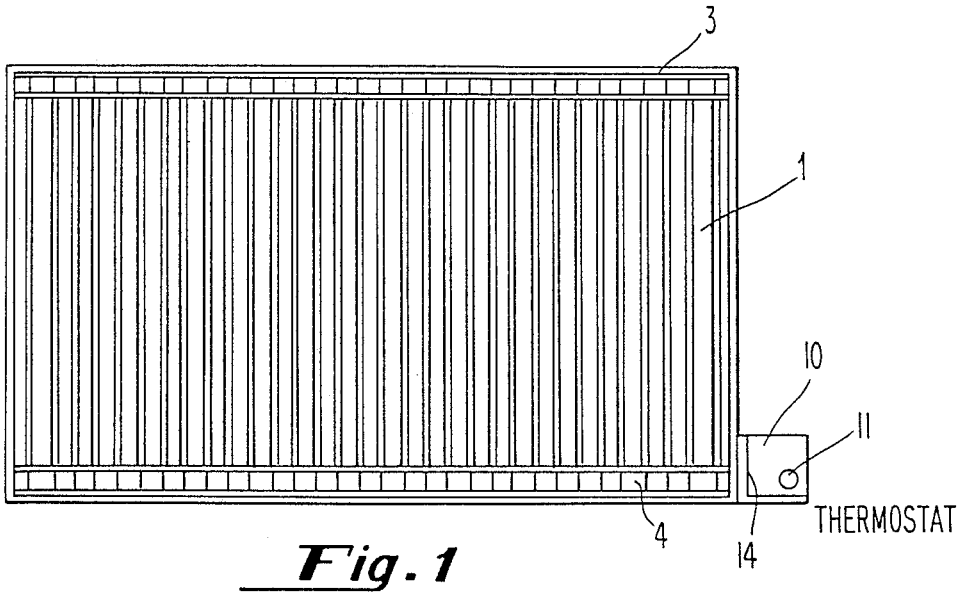

The present invention relates to a liquid-filled electric radiator having an upper distribution duct and a lower collection duct. The two ducts are in liquid communication with each other through on one hand, a number of connecting ducts within the radiator body and on the other hand, through a separate vessel connected to the radiator. The vessel is connected to the distribution and collection ducts at two diagonally opposing positions on the radiator and houses an electric immersion heating element for heating the liquid. The heating element is arranged in the part of the vessel immediately adjacent and parallel to the collecting duct.

BACKGROUND OF THE INVENTION

Liquid-filled electric radiators are coming more and more into use. The liquid in such radiators is usually transformer oil, which has suitable properties for the purpose. The immersion heater used for heating the oil is arranged within the space in the radiator which is used for the oil flow, usually a collection duct situated downwards in the radiator. In such a case the heater is inserted in the collection duct from one short end of the radiator. The insertion opening then being closed by a liquid-sealing stub through which the electric supply lines to the heater pass out to the inside of a casing for electric components. The casing is thus arranged as an extension of the lower end portion of the radiator. Such a known radiator is described in French Pat. No. 1 586 411.

Such known liquid-filled electric radiators have a disadvantage in that the liquid is heated by the immersion heater at the lowest point of the radiator to obtain circulation by convection. The heat-emitting plates of the radiator will thus be warmer downwards than they are upwards, which has an unfavourable effect on the air intended to be heated by the radiator, since the air in the room where the radiator is placed normally circulates from the floor and up to the ceiling. The known liquid-filled electric radiators, which emit more heat downwards near the floor than at their upper portion situated closer to the ceiling thus have poor efficiency. The cold air stream in the room first meets the highest temperature of the radiator and takes up heat, while the heat exchange further up along the radiator surface will be poor, since the air has already become well-heated at its previous contact with the lower portion of the radiator.

A further disadvantage in the known liquid-filled electric radiators is that due to the greater heat in the downward portions, where the casing for the electric components is also situated, the casing has a high interior temperature. Measurements have shown that in a liquid-filled electric radiator with a surface temperature of 80° C., the temperature inside the casing is approximately 40° C. This makes the casing unsuitable, if not impossible, as a location for mounting the radiator thermostat.

To solve the disadvantages mentioned above it has been proposed to arrange the electric immersion heating element in a separate vessel. Liquid-filled radiators of this type are known from, e.g. French Pat. No. 922 393. The radiators are of a casted grill type having the separate vessel arranged under the radiator body. The vessel is connected to the end of the collection duct via a longer return tube and to the end of the distribution duct via a separate ascending tube for the liquid heated in the vessel. An inconvenient drawback of the radiator shown in the French patent is the demand for a thermostat controlling the energy supply from the electric heating element independent of the temperature of the return liquid. Another drawback is that the vessel, as well, as the tubes, are arranged outside the border lines of the radiator body.

Also, electric radiators of panel type are previously known, e.g. from Norwegian Pat. Nos. 61 522 and 59 936, where a vessel body having a circular cross section is arranged in a vertical position between two parallel-plane panel radiator bodies. The vertical vessel is connected to the collection and distribution ducts through transverse branch pipes and contains a concentric tube housing an electric heating element. Thus, there is only an indirect liquid heating which gives the radiator a poor efficiency. Contributing to the poor efficiency is also that no optimum self circulation of the liquid is obtained by a vertical heating element.

SUMMARY OF THE INVENTION

It is an object of the present invention to provide a liquid-filled electric radiator of the type mentioned above but having improved performance with respect to construction as well as to function. This is obtained in such a way that the liquid system of the radiator is completely closed and through a radiator of panel type having the distribution, collection and connecting ducts shaped in a known manner between two press shaped and welded heat-emitting plates in combination with a separate vessel being in form of an angularly bent pipe having mainly a uniform cross section area and forming two sections of which one, the lower section, is arranged parallel to and in level with the collection duct and at its free end it is connected to the collection duct via a short branch pipe while the other section of the bent pipe is arranged to accompanying one short side of the radiator within the border line of the radiator body to have the free end thereof connected to the distribution duct, whereby the electric immersion heating element housed in the lower section has electric supply means arranged at the free end of the section having a stub which hermetically seals the pipe and through which pass electric lines for current supply to the element, said lines continuing to a casing for electrical components.

By having a vessel designed as an angularly bent pipe with a simple pipe joint to the distribution duct as well as to the collection duct of the radiator, a housing for the electric immersion heating element being well apt to the radiator area is obtained. The heater housing will then be well protected by the radiator body. The bent pipe as such is easy to assemble as well as the heating element introduced therein. The heating element is introduced in and separated from the bent pipe together with the stub. The uniform cross section area assists in obtaining optimum liquid flow through the radiator.

A further advantage of the liquid-filled radiator according to the invention is that, due to the low temperature of the radiator at the branch pipe connecting the collection duct to the lower section of the bent pipe, the casing for electric components can thus be arranged in close connection to the branch pipe, and accommodate a thermostat for detection of the air temperature. The thermostat in such a case is protected from direct heat radiation from the radiator by a wall protruding from the casing. Operation of the liquid-filled electric radiator in accordance with the invention has shown that the inside temperature of the casing is approximately 20° C. for a maximum surface temperature (80° C.) at the radiator.

PREFERRED EMBODIMENT

Figure 2:
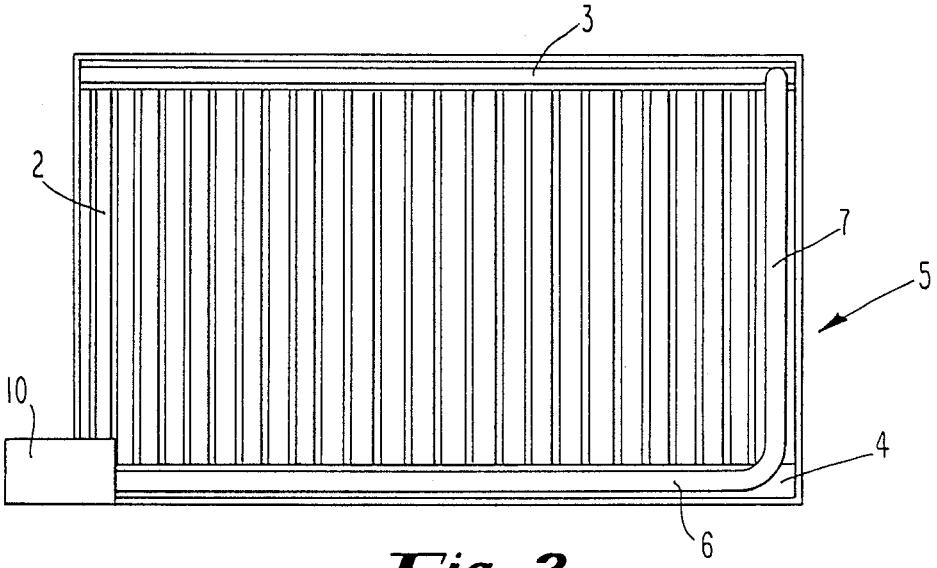
Figure 3:
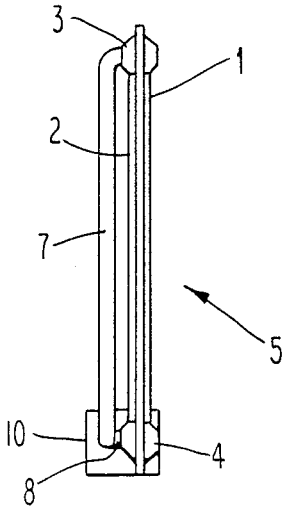
Figure 4:
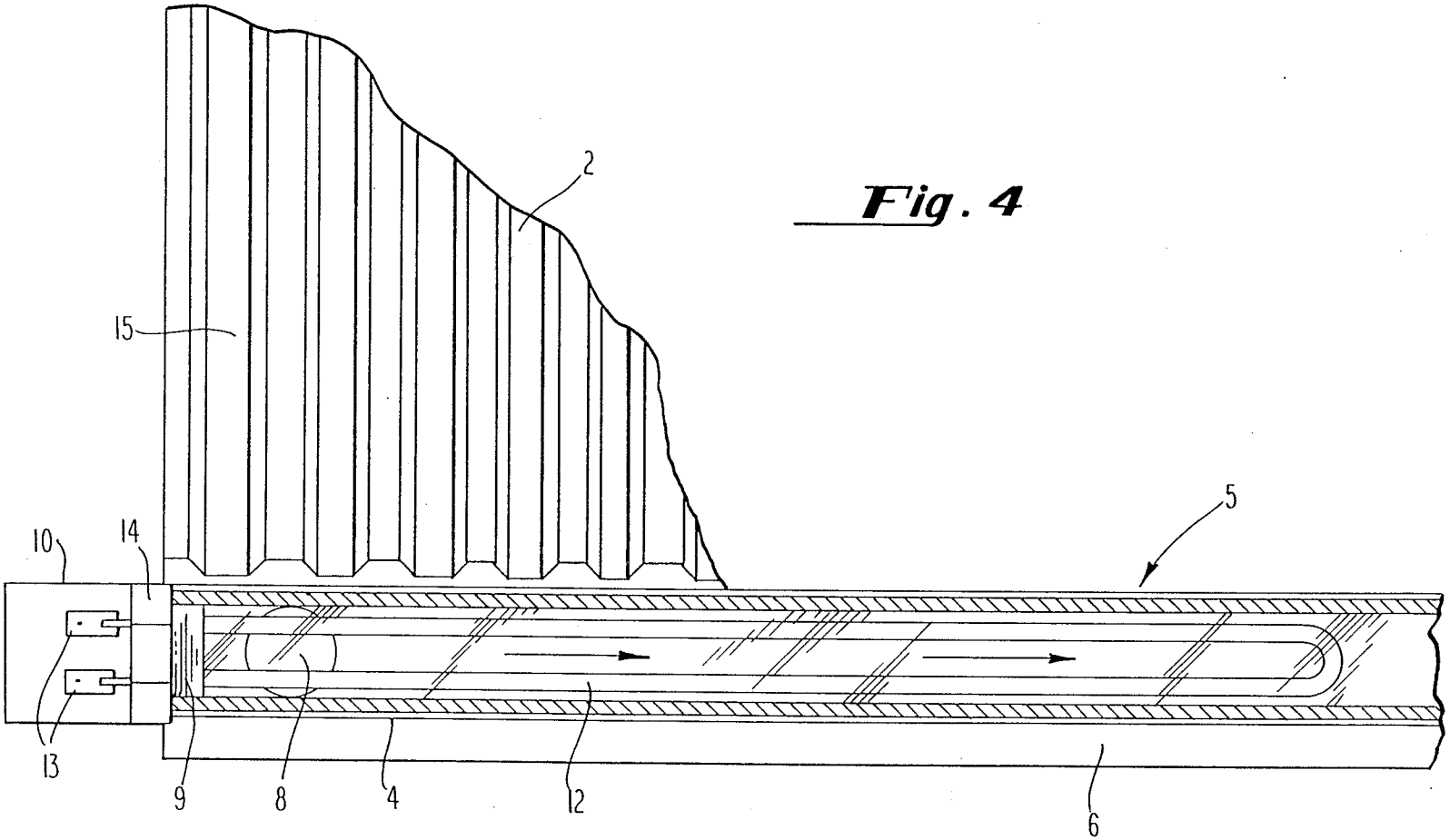

The invention will now be described in detail in connection with the preferred embodiment summarily described above, and which is illustrated on the accompanying drawings, where FIG. 1 is a front elevation of the liquid-filled electric radiator in accordance with the invention, FIG. 2 is the same radiator seen from the rear FIG. 3 is an end view of the radiator of FIG. 1; and FIG. 4 illustrates, partially in section, the lower part of the radiator at the connection end of the electric heating element, with the casing for electrical components removed.

As will be seen from FIG. 1, the preferred embodiment of the liquid-filled electric radiator in accordance with the invention has a front surface 1, the appearance of which agrees with that of a conventional water radiator, apart from a casing 10 with associated thermostat 11 or other heat-detecting regulating means, e.g., in the form of a known electric means. The front surface 1, as well as the rear surface 2 of the radiator (FIG. 2), has an upper distribution duct 3 connected to a lower collection duct 4 via connecting ducts 15 (FIG. 4).

The thermostat 11 is arranged on the front side of the casing 10 at a distance from the radiator body. The casing 10 has a wall 14 to protect the thermostat 11 from direct heat radiation from the radiator.

A pipe 5 comprising two sections 6, 7 is shown in FIG. 2 on the rear side 2 of the radiator. One section 6 is disposed parallel to, and at the same height as, the lower collection duct 4 and is coupled thereto at its free end, which is terminated in the casing 10. The other section 7 is disposed parallel to the end wall of the radiator remote from the casing 10, and has its free end connected to upper distribution duct 3. The pipe 5 is thus coupled to the internal liquid flow system of the radiator at diagonally opposed points on the radiator.

FIG. 4 is a longitudinal cross-section of the pipe section 6. It will be seen from the figure that the pipe 5 is in liquid-conducting communication with the radiator collection duct 4 via the branch pipe 8. The branch pipe 8 is arranged in the immediate vicinity of the pipe end, which is hermetically-sealed by a stub 9. An electric immersion heating element 12 is inserted in section 6 of the pipe 5 with the electrical supply lines of the element passing through the stub 9 out to the connection means 13. The connection means 13 are electrically connected to the electrical components (not shown in FIG. 4) disposed in the casing 10.

The section 6 of the pipe 5 is also advantageously utilized for suspending the radiator on a wall fastening. The wall fastening can thus be mounted for attaching to section 6.

In operation, the radiator is filled with liquid, preferably transformer oil. The element 12 is supplied with current in response to the setting on the thermostat 11. On being supplied with current, the element 12 heats the liquid in section 6 of the pipe 5. The heated liquid rises up through the other section 7 and into the radiator distribution duct 3. The hot liquid is then propagated in the radiator, as is usual with a radiator included in a central heating installation, and down to the lower collection duct 4. From the collection duct 4, the liquid then blows to section 6 via the branch pipe 8. Effective convection is thus obtained in the radiator, which has its highest temperature at the top at the input to the distribution duct 3. One of the cooler regions on the radiator is around the branch pipe 8, where the casing 10 for the thermostat 11 is also arranged.

Although the embodiment of the liquid-filled electric radiator in accordance with the invention described above and in connection with the drawings is the one preferred, the invention can be modified in different ways without departing from its principle. The present invention may thus not be regarded as restricted to the described and illustrated embodiment, and the scope thereof is determined entirely by the following claims.

We claim:

1. A liquid-filled electric radiator comprising a generally rectangular, vertically disposed radiator body having an upper horizontal distribution duct and a lower horizontal collection duct, said ducts being in liquid connection to each other through a plurality of connecting ducts within the radiator body and through a separate vessel in the form of an angularly bent pipe having a mainly uniform cross section and including a first section connected in series with a second section, said bent pipe having its free ends connected respectively to said upper and lower ducts at diagonally opposite positions on said radiator body, said first section of said pipe being arranged parallel to and in level with said lower collection duct and being connected at its free end to said lower duct via a short branch pipe, while said second section of said pipe is arranged parallel to and immediately adjacent the vertical side of the radiator body within the border line of the body and having its free end connected to the distribution duct, an electric immersion heating element housed in said first section for heating a liquid filling said ducts and said vessel, said first section having a hermetically sealed connection at its free end through which pass means for energizing the immersion heating element.

2. The radiator according to claim 1 wherein a casing for electrical components is arranged at the lower corner of the radiator body in close proximity to said branch pipe and accommodates a thermostat for detection of the air temperature, whereby the thermostat is protected from the direct heat radiation from the radiator body by a partition on said casing protruding from said casing.

3. The radiator according to claim 1 wherein said bent pipe is arranged with an air gap between the surface of the radiator body and the surface of the bent pipe.

* * * * *